US009744765B2

(12) United States Patent
Giusti et al.

(10) Patent No.: US 9,744,765 B2
(45) Date of Patent: Aug. 29, 2017

(54) FLUID EJECTION DEVICE WITH RESTRICTION CHANNEL, AND MANUFACTURING METHOD THEREOF

(71) Applicant: STMICROELECTRONICS S.R.L., Agrate Brianza (IT)

(72) Inventors: Domenico Giusti, Monza (IT); Lorenzo Colombo, Besana in Brianza (IT); Carlo Luigi Prelini, Seveso (IT); Mauro Cattaneo, Sedriano (IT)

(73) Assignee: STMICROELECTRONICS S.R.L., Agrate Brianza (IT)

( * ) Notice: Subject to any disclaimer, the term of this patent is extended or adjusted under 35 U.S.C. 154(b) by 0 days.

(21) Appl. No.: 15/191,154

(22) Filed: Jun. 23, 2016

(65) Prior Publication Data

US 2017/0151784 A1 Jun. 1, 2017

(30) Foreign Application Priority Data

Nov. 30, 2015 (IT) ..... 102015000078380

(51) Int. Cl.
*B41J 2/045* (2006.01)
*B41J 2/14* (2006.01)
*B41J 2/16* (2006.01)

(52) U.S. Cl.
CPC ..... *B41J 2/14201* (2013.01); *B41J 2/1607* (2013.01); *B41J 2/1626* (2013.01)

(58) Field of Classification Search
CPC .... B41J 2/14201; B41J 2/1626; B41J 2/1607; B41J 2/14233
See application file for complete search history.

(56) References Cited

U.S. PATENT DOCUMENTS 6,802,598 B2 10/2004 Ito et al.
8,991,954 B2 3/2015 Govyadinov et al.
2002/0056698 A1 5/2002 Makigaki et al.
(Continued)

FOREIGN PATENT DOCUMENTS

EP 1070590 A2 1/2001
WO 2013032471 A1 3/2013

OTHER PUBLICATIONS

Zhang et al., "New Developments in Epson's Inkjet Head Technology," *21st International Conference on Digital Printing Technologies Final Program and Proceedings*, Baltimore, MD, USA, Sep. 18-23, 2005, pp. 269-272.

*Primary Examiner* — Juanita D Jackson
(74) *Attorney, Agent, or Firm* — Seed Intellectual Property Law Group LLP

(57) ABSTRACT

A fluid ejection device, comprising: a first semiconductor body including an actuator, which is operatively coupled to a chamber for containing the fluid and is configured to cause ejection of the fluid; and a channel for inlet of the fluid, which extends in a first direction and has a section having a first dimension; and a second semiconductor body, which is coupled to the first semiconductor body and has an ejection nozzle configured to expel the fluid. The second semiconductor body further comprises a first restriction channel, which is fluidically coupled to the inlet channel, extends in a second direction orthogonal to the first direction and has a respective section with a second dimension smaller than the first dimension so as to form a restriction between the inlet channel and the chamber.

18 Claims, 9 Drawing Sheets

(56) References Cited

U.S. PATENT DOCUMENTS

| | | | | |
|---|---|---|---|---|
| 2009/0009564 | A1 | 1/2009 | Yamazaki | |
| 2013/0135395 | A1* | 5/2013 | Lee | B41J 2/14233 347/54 |
| 2014/0078224 | A1 | 3/2014 | Park et al. | |
| 2014/0085383 | A1* | 3/2014 | Yoda | B41J 2/14 347/50 |

* cited by examiner

FLUID EJECTION DEVICE WITH RESTRICTION CHANNEL, AND MANUFACTURING METHOD THEREOF

BACKGROUND

Technical Field

The present disclosure relates to a fluid ejection device with restriction channel and to a method for manufacturing the fluid ejection device.

Description of the Related Art

Multiple types of fluid ejection devices are known, in particular inkjet heads for printing applications. Similar heads, with appropriate modifications, may further be used for ejection of fluid other than ink, for example, for applications in the biological or biomedical field, for local application of biological material (e.g., DNA) during manufacturing of sensors for biological analyses.

Manufacturing methods envisage coupling via gluing or bonding of a large number of pre-processed wafers. This method is costly and typically requires high precision. Misalignment between the wafers during assembly may entail both structural weakness and non-optimal operation of the finished device.

BRIEF SUMMARY

One or more embodiments of the present disclosure provide a fluid ejection device with restriction channel and a method for manufacturing the fluid ejection device.

In particular, a fluid ejection device according to one embodiment includes a first semiconductor body including an actuator, a chamber for containing a fluid, and an inlet channel. The actuator is configured to cause ejection of the fluid during an operating condition of the ejection device. The inlet channel is configured to provide fluid to the chamber. The inlet channel extends in a first direction and has a section having a first dimension. The fluid ejection device also includes a second semiconductor body coupled to the first semiconductor body. The second semiconductor body has an ejection nozzle that is in fluidic communication with the chamber and is configured to expel an amount of fluid towards an environment external to the ejection device. The second semiconductor body comprises a first restriction channel fluidically coupled to the inlet channel. The first restriction channel extends in a second direction that is orthogonal to the first direction. The first restriction channel has a section having a second dimension that is smaller than the first dimension. The restriction channel forms a fluidic path that fluidically couples the inlet channel to the chamber.

BRIEF DESCRIPTION OF THE SEVERAL VIEWS OF THE DRAWINGS

For a better understanding of the present disclosure, preferred embodiments thereof are now described, purely by way of non-limiting example, with reference to the attached drawings, wherein.

DETAILED DESCRIPTION

Figure 1A:
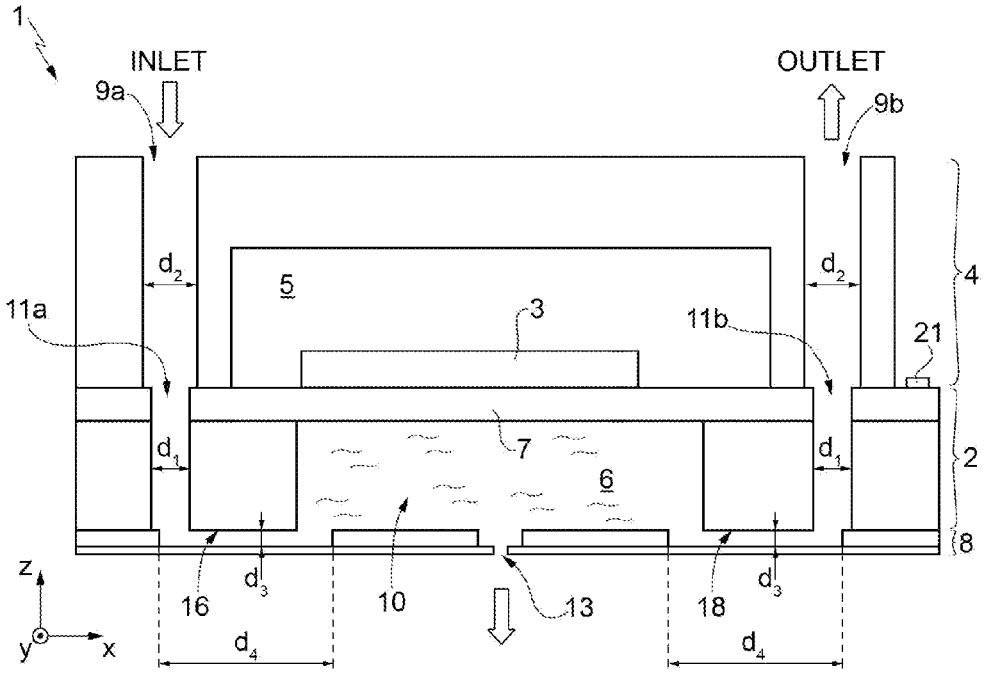
FIG. 1A is a lateral sectional view of a fluid ejection device according to one embodiment of the present disclosure.

Fluid ejection devices based upon the piezoelectric technology may be manufactured by bonding or gluing together a plurality of wafers or chips previously processed employing micromachining technologies typically used for producing MEMS (Micro-Electro-Mechanical Systems) devices. In particular, FIG. 1A shows a liquid-ejection device 1 according to one aspect of the present disclosure. The liquid-ejection device 1 is oriented in a triaxial system of Cartesian axes X, Y, Z. With reference to FIG. 1A, a first chip or wafer 2, which lies in a plane parallel to the plane XY, has one or more piezoelectric actuators 3, which are designed to be driven for generating a deflection of a membrane 7 that extends partially suspended over a chamber 10 designed to define a reservoir for containing fluid 6 to be expelled in use. In some embodiments, the chamber 10 is coupled to a reservoir (not shown).

In a way not shown in detail in FIG. 1A, but described in what follows, the piezoelectric actuator 3 includes: a first electrode of conductive material, which extends over the membrane 7; a piezoelectric element which extends over, and electrically coupled to, the first electrode; and a second electrode of conductive material, which extends over the piezoelectric element and is electrically coupled thereto. The first and second electrodes are driven, in use, in order to actuate the piezoelectric element, thus generating a deflection of the membrane 7.

An intermediate channel 11*a* for inlet of the fluid 6 into the chamber 10 and an intermediate channel 11*b* for outlet of the fluid 6 from the chamber 10 extend throughout the thickness of the wafer 2.

In use, when the piezoelectric actuator 3 is driven, a drop of the fluid 6 is expelled through one or more nozzles 13, which is provided in a further wafer or chip that is distinct from the first wafer 2. The intermediate inlet and outlet channels 11*a*, 11*b* both have a circular or polygonal shape, with a diameter $d_1$ (measured in the direction X) between 20 μm and 200 μm, for example 100 μm, and a section area with a dimension $A_1$ between 20 μm and 200 μm, for example 80 μm. According to one embodiment, the section of the intermediate inlet and outlet channels 11*a*, 11*b* is uniform throughout their extension along Z.

A second chip or wafer 4, which lies in a plane parallel to the plane XY and is arranged on the first wafer 2, has one or more chambers 5 for containing the piezoelectric actuators 3 such as to isolate, in use, the piezoelectric actuators 3 from the fluid 6 to be expelled and from the environment. The second wafer 4 further has a channel 9*a* for inlet of the fluid 6 and a channel 9*b* for outlet of the fluid 6 not ejected through the nozzle 13, thus enabling recirculation of the fluid 6. The inlet and outlet channels 9*a*, 9*b* are through holes made through the second wafer 4. The inlet and outlet channels 9*a*, 9*b* both have a circular or polygonal shape, with diameter $d_2$ (measured in the direction X) greater than the diameter $d_1$, and between 30 μm and 1000 μm, for example 180 μm. The inlet channel 9*a* may be coupled to a reservoir for supplying fluid to the chamber 10.

The inlet and outlet channels 9*a*, 9*b* further have a section area with a dimension $A_2$ between 50 μm and 1000 μm, for example 200 μm, where $A_2$ is chosen greater than $A_1$.

According to one embodiment, the section of the inlet and outlet channels 9*a*, 9*b* is uniform throughout their extension along Z.

The inlet channel 9*a* is fluidically coupled to the intermediate inlet channel 11*a*, and the outlet channel 9*b* is fluidically coupled to the intermediate outlet channel 11*b*. In greater detail, the inlet and outlet channels 11*a*, 11*b* are respectively aligned, in a direction Z orthogonal to the plane XY, to the inlet and outlet channels 9*a*, 9*b*.

A third chip or wafer 8, which lies in a plane parallel to the plane XY and is arranged underneath the first wafer 2, has the nozzle 13 for ejection of the fluid 6 in fluidic connection with the chamber 10.

Coupling of the first and third wafers 2, 8 enables formation of the chamber 10, the latter being delimited in part by the first wafer 2 and in part by the third wafer 8.

According to an aspect of the present disclosure, the third wafer 8 has a first restriction channel 16 and a second restriction channel 18, each in the form of a trench that extends in depth in the direction Z and longitudinally in the plane XY, with main extension along X. The first and second restriction channels 16, 18 fluidically connect, respectively, the intermediate inlet channel 11*a* with the chamber 10 and the chamber 10 with the intermediate outlet channel 11*b*. More in particular, according to an aspect of the present disclosure, the first and second restriction channels 16, 18 are fluidically connected directly to the chamber 10. The first and second restriction channels 16, 18 have: a depth $d_3$, along Z, between 2 μm and 300 μm, for example, 30 μm; a main extension $d_4$, along X, between 2 μm and 300 μm, for example, 40 μm; and a secondary extension (not represented), along Y, between 10 μm and 1000 μm, for example, 400 μm.

More in particular, the first and second restriction channels 16, 18 have a uniform section (area) transverse to the direction of flow of the fluid (in this case, X) having a dimension $A_3$ between 2 μm and 300 μm, for example, 30 μm. According to a different embodiment, the first restriction channel 16 has a section that is not uniform, but such as to have a maximum value of dimension at the intersection between the first restriction channel 16 and the intermediate inlet channel 11*a* in order to facilitate (during manufacturing) coupling together, as well as entry of the fluid coming from the intermediate inlet channel 11*a* into the first restriction channel 16. Alternatively, or in addition, also the second restriction channel 18 has a maximum value of dimension of section at the intersection thereof with the intermediate outlet channel 11*b* in order to facilitate (during manufacture) the step of coupling thereof.

Irrespective of the embodiment, the first and second restriction channels 16, 18 have at least a respective section smaller than any section of the intermediate inlet and outlet channels 11*a*, 11*b*, respectively.

Further, the first and second restriction channels 16, 18 have at least a respective section smaller than any section of the inlet and outlet channels 9*a*, 9*b*, respectively.

In use, the fluid 6 flows through the inlet channel 9*a* and the intermediate inlet channel 11*a* in the direction Z, and then flows through the first restriction channel 16, in the direction X, orthogonal to the direction Z, and then enters the chamber 10. In use, as a result of the deflection of the membrane 7 towards the inside of the chamber 10, controlled by the piezoelectric actuator 3, a portion of the fluid 6 is ejected through the nozzle 13, while another portion of the fluid 6 is conveyed towards the outlet channel 9*b*, flowing first in the direction X through the second restriction channel 18 and then in the direction Z through the intermediate outlet channel 11*b* and the outlet channel 9*b*.

The first and second restriction regions have the function of reducing the flow of the fluid 6 in a direction opposite to the one previously described (in particular, reducing return of the fluid 6 towards the inlet channel) during ejection of the fluid 6 through the nozzle 13. Provision of the first and second restriction channels 16, 18 in the third wafer 8, which have a main extension parallel to the plane of lie of the third wafer 8, makes it possible to limit the thickness, along Z, of the ejection device 1 and to facilitate coupling between the wafers 2, 4, and 8 in so far as it is not necessary to meet precise requirements or specifications of alignment between the channels. In fact, it is sufficient for the intermediate inlet channel 11*a* and the first restriction channel 16 to be in fluidic communication with one another for the characteristics of operation of the ejection device 1 not to be jeopardized.

According to an embodiment of the present disclosure, the aforementioned wafers 2, 4, 8 are of semiconductor material such as silicon, and may be chips or dice that were formed from respective wafers, each including a plurality of chips that are separated in a dicing process. Conductive layers of doped silicon, or doped polysilicon, or metal, may further be provided (in a per se known manner, not shown in the figure) for electrically coupling the piezoresistive element to conductive pads 21, used for driving the piezoelectric element 3 so as to cause deflection of the membrane 7. Dielectric or insulating layers may further be present, according to the need.

The wafers 2, 4, 8 are assembled together by interface bonding regions and/or gluing regions and/or adhesive regions. Said regions are not shown in detail in FIG. 1A.

Figure 1B:
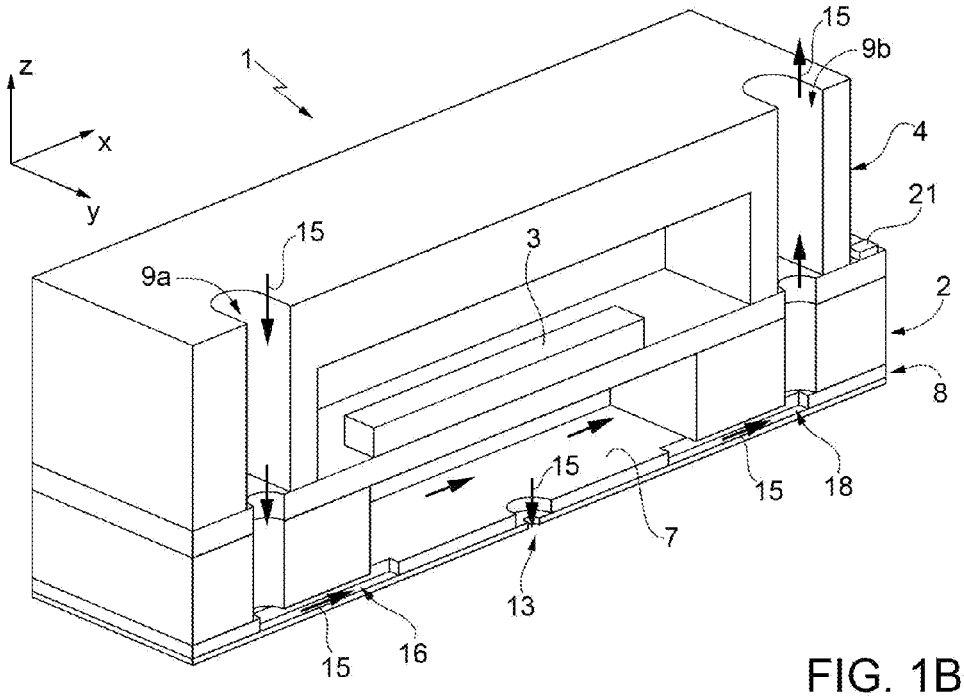
FIG. 1B is a perspective view of a portion of the fluid ejection device of FIG. 1A.

FIG. 1B is a perspective view of a portion of the ejection device 1 of FIG. 1A, sectioned according to the cross-section shown in FIG. 1A. A complete ejection device 1 will be formed by joining the portion shown in FIG. 1B with a portion similar and specular thereto.

In FIG. 1B, the path of the fluid, in use, is represented by arrows 15. The remaining elements of the ejection device 1 are designated by the same reference numbers as those used in the description of FIG. 1 and are not described any further.

With reference to FIGS. 2-20 a process for manufacturing the fluid ejection device 1 of FIG. 1 is now described, according to one embodiment of the present disclosure.

With reference to FIGS. 2-10, there follows a description of steps of processing of the first wafer 2, which houses, in this example, an actuator element (in particular of a piezoelectric type) designed to be driven, in use, for expelling a liquid/fluid from the ejection device 1.

Figure 2:
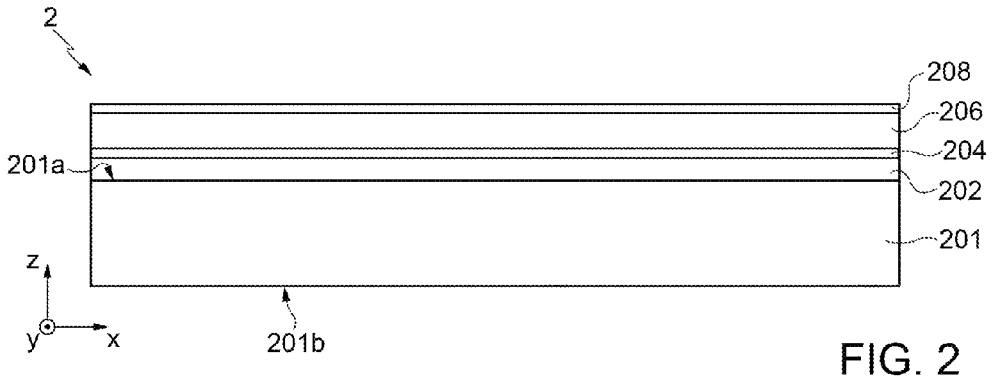
FIGS. 2-20 show steps for manufacturing the fluid ejection device of FIGS. 1A and 1B.

With reference to FIG. 2, the wafer 2 is provided including a substrate 201 having, for example, a thickness between approximately 50 μm and 720 μm, in particular approximately 500 μm. According to an embodiment of the present disclosure, the substrate 201 is of semiconductor material, such as silicon. The substrate 201 has a first surface 201*a* and a second surface 201*b*, opposite to one another in the direction Z. Formed on the first surface 201*a* is a membrane layer 202, made, for example, of silicon oxide, having a thickness between approximately 1 and 4 μm, in particular 2.5 μm. The membrane layer 202 forms, at the end of the manufacturing steps, the membrane 7 of FIG. 1A. Then formation of a stack is carried out including a piezoelectric element and electrodes for actuation of the piezoelectric element. For this purpose, deposited on the wafer 200, over the membrane layer 202, is a first layer of conductive material 204, for example titanium (Ti) or platinum (Pt), having a thickness between approximately 20 and 100 nm. Deposited on the first layer of conductive material 204 is a layer of piezoelectric material 206, for example PZT (Pb, Zr, $TiO_3$), having a thickness between 1.5 and 2.5 μm, in particular 2 μm. Then, deposited on the layer of piezoelectric material 206, is a second layer of conductive material 208, for example ruthenium, having a thickness between approximately 20 and 100 nm.

Figure 3:
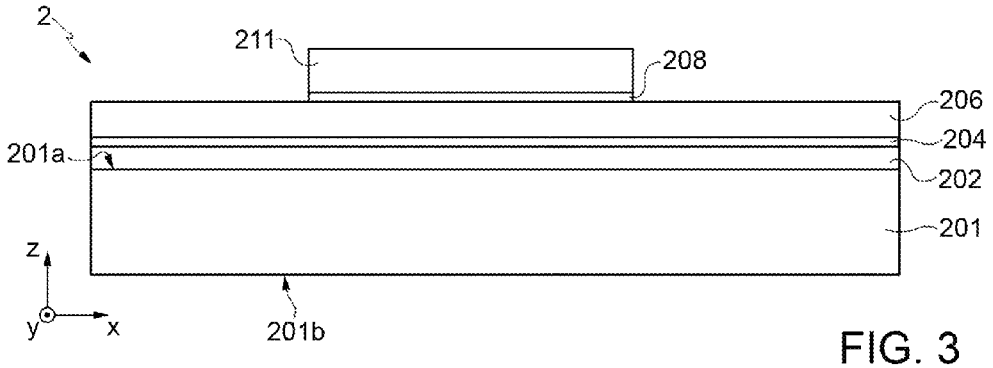
Figure 4:
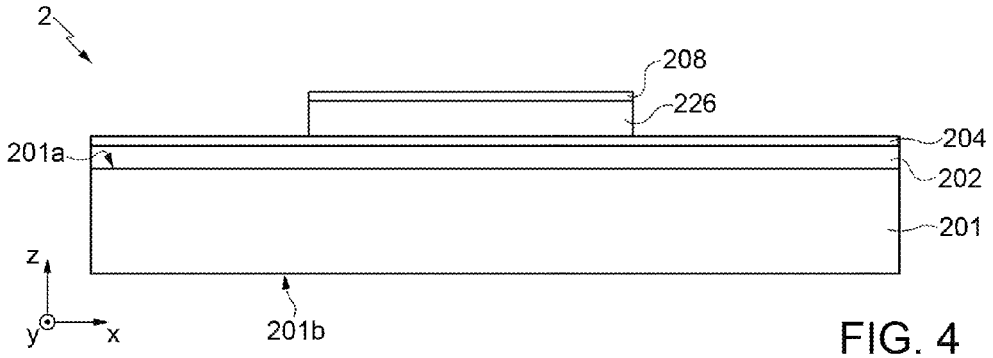

As shown in FIG. 3, formed on the second layer of conductive material 208 is a mask 211, designed to cover the second layer of conductive material 208 in portions of the latter that will then form a top electrode for actuation of the piezoelectric element. An etching step enables removal of portions of the second layer of conductive material 208 not protected by the mask 211. Using the same mask 211, but a different etching chemistry, etching of the wafer 200 is carried out to remove exposed portions of the layer of piezoelectric material 206 so as to form a piezoelectric element 226. Etching is interrupted on the first layer of conductive material 204 and (FIG. 4) the mask 211 is removed. Etching of the second layer of conductive material 208 is carried out, for example, by wet etching, and etching of the piezoelectric layer 206 by dry or wet etching.

Figure 5:
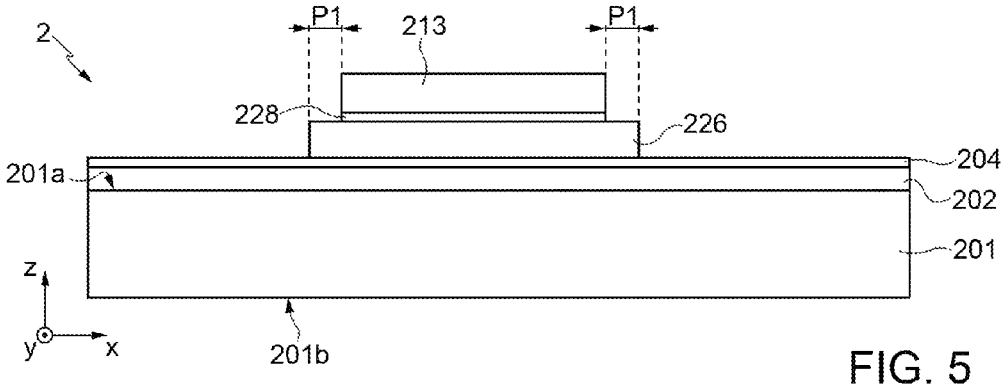

As shown in FIG. 5, the second layer of conductive material 208 is defined to conclude formation of the top electrode. For this purpose, a mask 213 is formed (for example, of photoresist) on part of the second layer of conductive material 208 for removing selective portions thereof that extends on the outer edge of the piezoelectric element 226, but not portions of the second layer of conductive material 208 that extends at the center of the piezoelectric element 226. The portion of the piezoelectric element 226 exposed following upon the etching step of FIG. 5 forms, in top plan view, a frame that surrounds completely or partially the top electrode 228 and has a width P1, for example measured in the direction X, comprised between 4 and 8 μm. A top electrode 228 is thus formed, designed to be biased, in use, for actuating the piezoelectric element 226 (as is described more fully in what follows).

Figure 6:
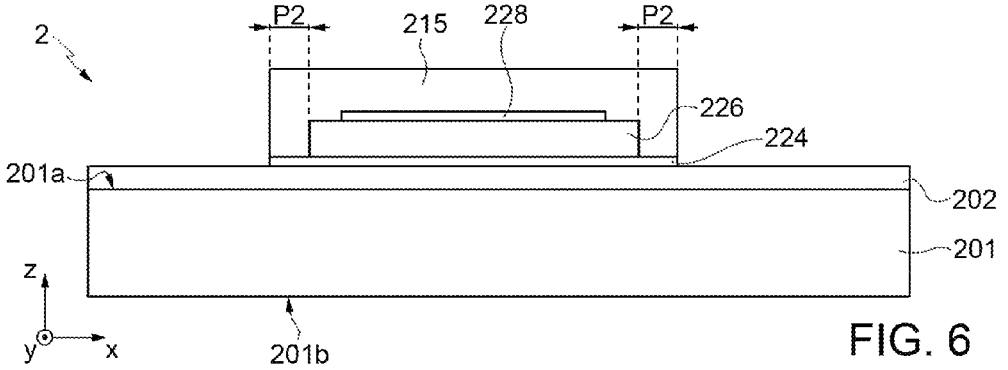

As shown in FIG. 6, a mask 215 (for example, of photoresist) is formed, which is designed to protect the top electrode 228 and the piezoelectric element 226 and extends laterally with respect to the piezoelectric element 228 for a distance P2, measured in the direction X starting from the edge of the piezoelectric element 228, between 2 and 8 μm. Then, an etching step is carried out to remove portions of the first layer of conductive material 204 not protected by the mask 215. A bottom electrode 224 is thus formed, for actuating, in use, the piezoelectric element.

Figure 7:
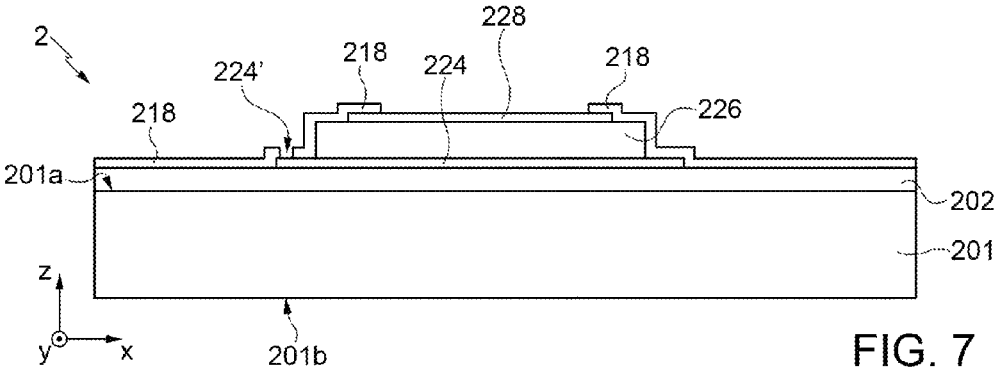

As shown in FIG. 7, the mask 215 is removed from the wafer 200 and a step of deposition of a passivation layer 218 on the wafer 200 is carried out. The passivation layer is, for example, of silicon oxide ($SiO_2$) deposited with the PECVD technique, and has a thickness between approximately 15 and 495 nm, for example, approximately 300 nm. With a subsequent lithographic and etching step, the passivation layer 218 is selectively removed on a central portion of the top electrode 228, whereas it remains on an edge portion of the top electrode 228, of the piezoelectric element 226, of the bottom electrode 224, and of exposed portions of the membrane layer 202.

According to what has been described so far, the passivation layer 218 does not coat completely the top electrode 228, which may thus be electrically contacted by a conductive path. Instead, the bottom electrode 224 is not electrically accessible, since it is completely protected by the overlying piezoelectric element 226 and the passivation layer 218. Simultaneously, a step of selective removal of a portion of the passivation layer 218 is carried out in an area corresponding to the bottom electrode 224, and in particular to the portion of the bottom electrode 224 that extends, in the plane XY, beyond the outer edge of the piezoelectric element 226. In this way, a region 224' of the bottom electrode 224 is exposed and may thus be electrically contacted by an own conductive path. The openings for forming the electrical contacts with the top electrode 228 and the bottom electrode 224 may be formed during a same lithographic and etching step (in particular using a same mask).

Figure 8:
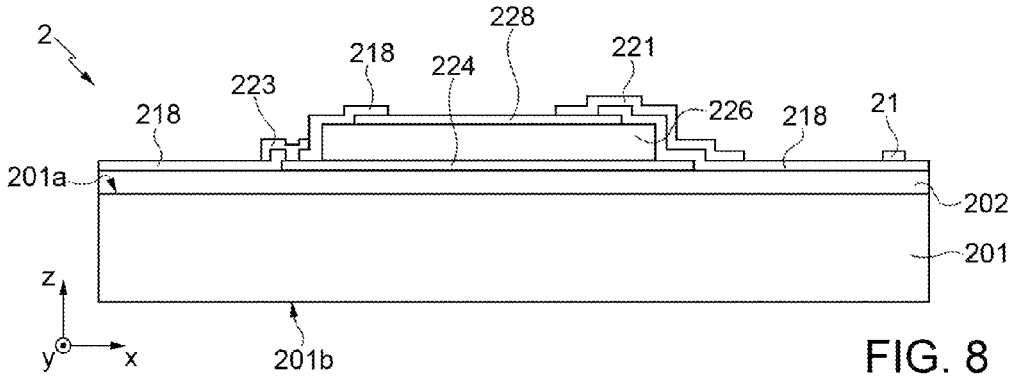

The step of formation of a first conductive path 221 and a second conductive path 223 is shown in FIG. 8. For this purpose, a step of deposition of conductive material, such as for example a metal, in particular titanium or gold is carried out, until a layer is formed having a thickness between approximately 20 and 500 nm, for example, approximately 400 nm. By photolithographic steps, the layer of conductive material thus deposited is selectively etched to form the first conductive path 221, which extends over the wafer 200 in electrical contact with the top electrode 228, and the second conductive path 223, which extends over the wafer 200 in electrical contact with the bottom electrode 224, through the region 224' previously formed. The first and second conductive paths 221, 223 extend over the wafer 200 as far as regions where it is desired to form the conductive pads 21 designed to act as electrical access points for biasing, in use, the top electrode 228 and bottom electrode 224 so as to actuate the piezoelectric element 226, in a per se known manner.

Figure 9:
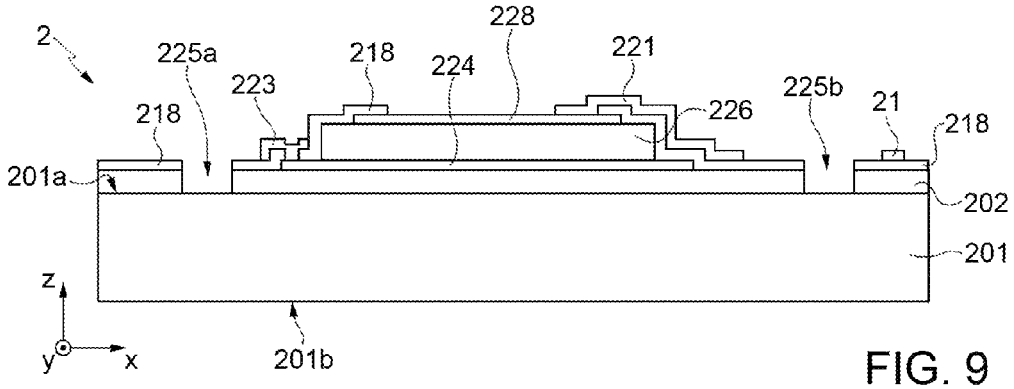

As shown in FIG. 9, the passivation layer 218 and the membrane layer 202 are selectively etched in respective regions that extend alongside the stack formed by the bottom electrode 224, the piezoelectric element 226, and the top electrode 228, to form respective trenches 225*a*, 225*b* that expose surface portions of the substrate 201. The trenches 225*a*, 225*b* have, in top plan view, a quadrangular shape or a circular shape, in any case with a maximum diameter $d_1$ such as to be completely contained, in top plan view when aligned along Z, by the channels 9*a*, 9*b* described with reference to FIG. 1A. In particular, according to one embodiment, the trenches 225*a*, 225*b* have, in top plan view a shape equal to the shape chosen, once again in top plan view, for the channels 9*a*, 9*b*. In any case, irrespective of the shape chosen for the trenches 225*a*, 225*b*, in subsequent manufacturing steps they will be arranged aligned, in the direction Z, with a respective channel 9*a*, 9*b* so as to be in fluidic connection with one another.

Figure 10:
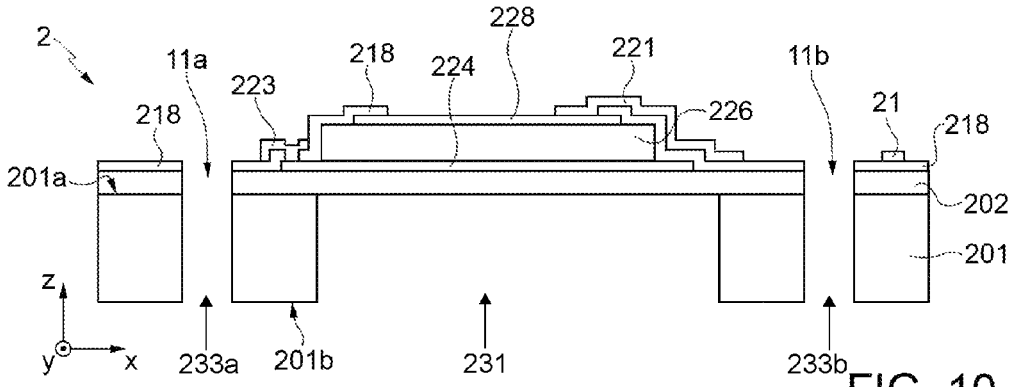

As shown in FIG. 10, a step of etching from the back 201*b* of the substrate 201 is carried out to form a recess 231 in a position corresponding to the piezoelectric element 226 (the recess defining, in subsequent steps, the chamber 10). The recess 231 is obtained by etching the substrate 201 until the membrane layer 202 is reached. According to one embodiment, the membrane layer 202 acts as etch-stop layer. Simultaneously, the substrate 201 is etched in order to form a first through hole 233*a* and a second through hole 233*b* in positions corresponding to the trenches 225*a*, 225*b* respectively, so that the first through hole 233*a* and the trench 225*a* will form, together, the intermediate inlet channel 11*a*, and the second through hole 233*b* and the trench 225*b* will form, together, the intermediate outlet channel 11*b*. To form the intermediate inlet and outlet channels 11*a*, 11*b* it is expedient to provide alignment markers, in a per se known manner.

As an alternative to what has been described, it is further possible to etch the substrate 201 on surface portions exposed through the trenches 225*a*, 225*b*, to form the through holes 233*a*, 233*b*. In this way, it is not necessary to provide alignment markers.

FIGS. 11-14 show steps of micromachining of the second wafer 4, which includes the cavity 5 for housing the piezoelectric actuator and the channels for inlet 9*a* and outlet 9*b* of the fluid 6.

Figure 11:
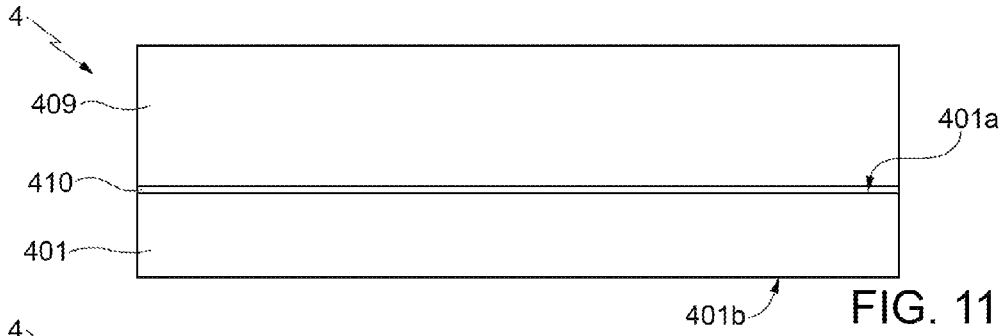

With reference to FIG. 11, the wafer 4 is provided, including a substrate 401, for example having thickness between approximately 100 μm and 1000 μm, in particular approximately 725 μm. The substrate 401 is made, according to an embodiment of the present disclosure, of semiconductor material, such as silicon. The substrate 401 has a first surface 401*a* and a second surface 401*b*, opposite to one another in a direction Z. Formed on the substrate 401 is a structural layer 409, made, for example, of polysilicon or epitaxially grown silicon. There may further be provided an interface layer 410 between the substrate 401 and the structural layer 409, made for example of silicon oxide ($SiO_2$).

Figure 12:
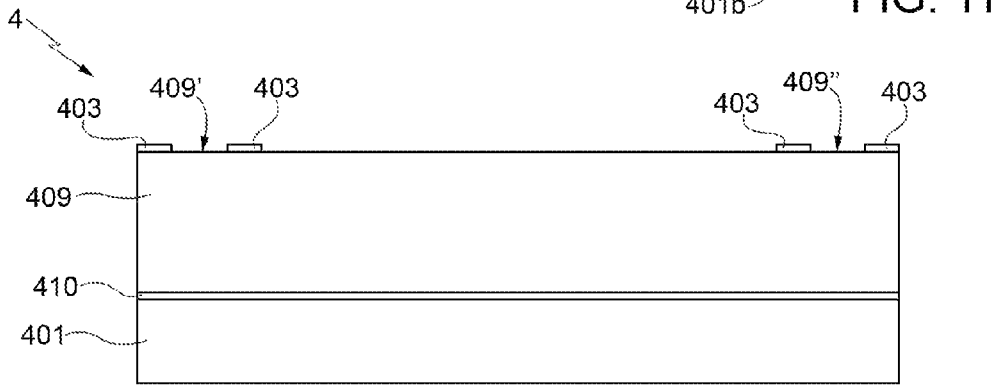
Figure 13:
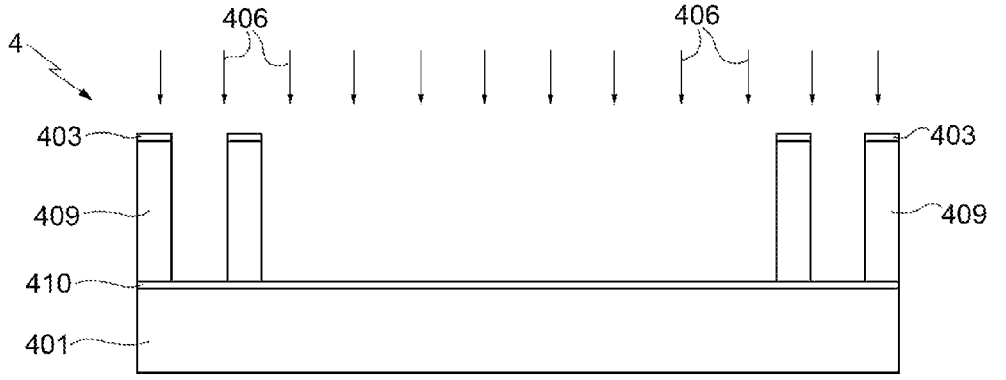
Figure 14:
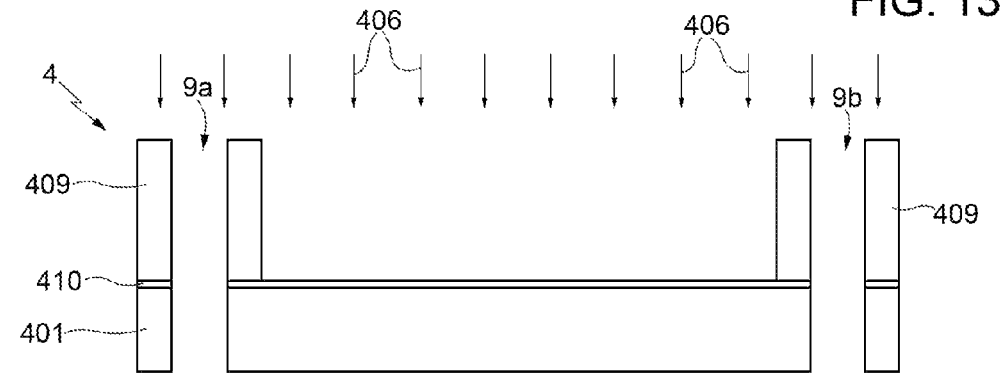

As shown in FIG. 12, a step of formation of a mask 403 on the structural layer 409 is carried out. For this purpose, a mask layer 403 is formed, made, for example, of photoresist. The mask layer 403 is defined lithographically so as to form a mask region designed to delimit portions 409' and 409" of the wafer 4 that, in subsequent steps, will form the inlet and outlet channels 9*a*, 9*b*, and a portion 409'" of the wafer 4 that, in subsequent steps, will form the containment chamber 5. Then, by an etching step shown in FIG. 13 (represented with the arrows 406), the region of the structural layer 409 that extends over the surface portions thereof that are not protected by the mask 403 is partially or completely removed. The interface layer 410 between the substrate 401 and the structural layer 409 functions as etch-stop layer.

A further step of masked etching (FIG. 14) just in regions of the wafer 4 where the inlet and outlet channels 9*a*, 9*b* are to be formed enables complete removal of the exposed substrate regions 401 (and of the possible interface layer) to form through holes that provide the inlet and outlet channels 9*a*, 9*b*, which extend throughout the thickness, along Z, of the wafer 4.

The process steps described with reference to FIGS. 2-10 (processing of the first wafer 2) may be carried out in parallel or else in temporal sequence, with respect to the process steps of Figures and 11-14 (processing of the second wafer 4), indifferently.

Figure 15A:
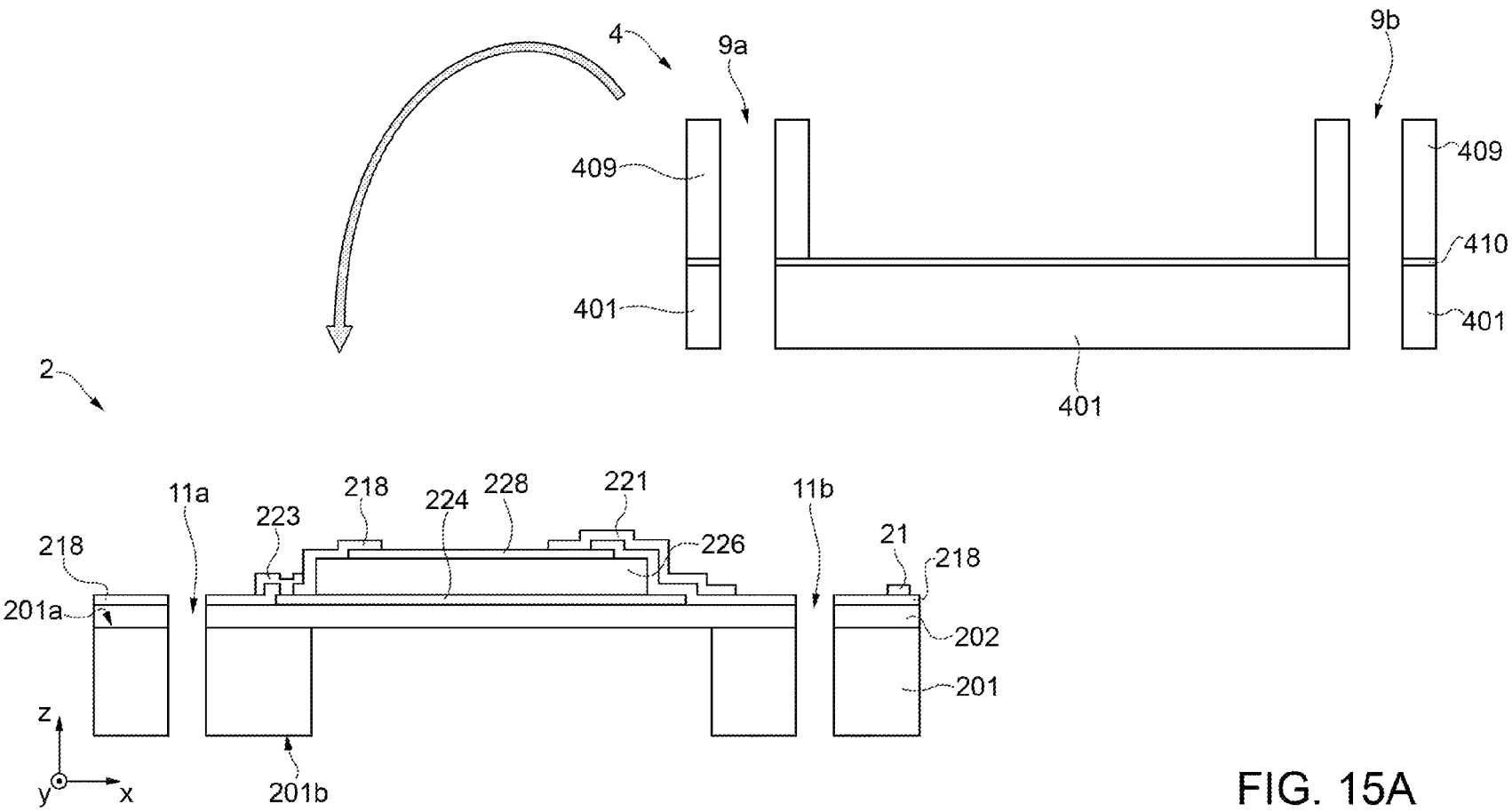

In any case, with reference to FIG. 15A, the second wafer 4 (in the processing step of FIG. 13) and the first wafer 2 (in the processing step of FIG. 10) are coupled together so that: the inlet channel 9*a* and the intermediate inlet channel 11*a* will be substantially aligned to one another in the direction Z and in fluidic connection with one another; the outlet channel 9*b* and the intermediate outlet channel 11*b* will be substantially aligned to one another in the direction Z and in fluidic connection with one another; and the chamber 5 will surround entirely the piezoelectric element 226.

Figure 15B:
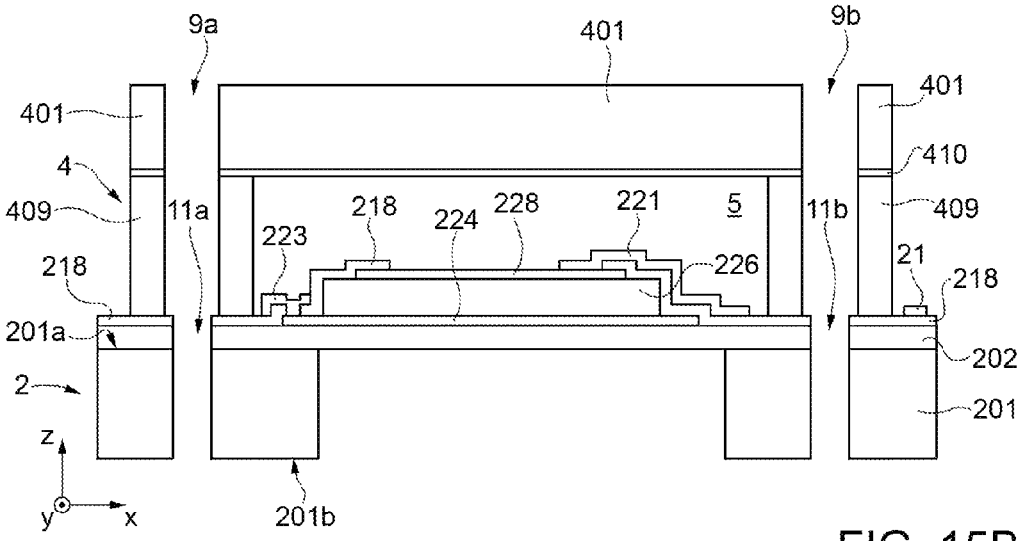

FIG. 15B shows the first wafer 2 and the second wafer 4 at the end of the coupling step of FIG. 15A.

With reference to the wafer 4, the portions of the structural layer 409 that extend to a height, along Z, greater than does the recess that forms the chamber 5, are the regions provided for mechanical coupling with the wafer 2. During the coupling step shown in FIG. 15A, to guarantee a good adhesion between the wafers 2 and 4, a bonding polymer (not shown) is applied on the wafer 4 on the mechanical-coupling regions. After a step of alignment and coupling between the wafers 2 and 4, a step of thermal treatment (which varies in duration and temperature according to the bonding polymer used) enables complete adhesion of the wafers 2 and 4 to one another.

Figure 16:
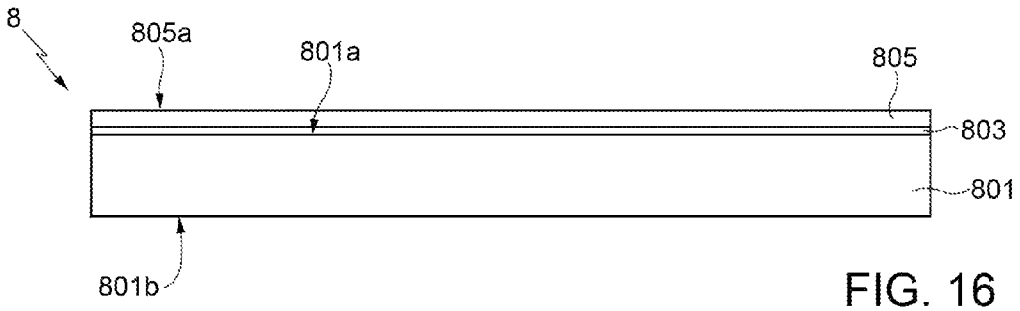

With reference to FIG. 16, steps for processing the third wafer 8 are now described. These processing steps may be indifferently carried out simultaneously with any of the steps described with reference to FIGS. 2-15B, or else previously, or else subsequently.

With reference to FIG. 16, the third wafer 8 is provided including a substrate 801, for example of semiconductor material, in particular silicon, having a top face 801*a* and a bottom face 801*b* opposite to one another in the direction Z.

Formed on the first surface 801*a*, for example by thermal oxidation, is an interface layer 803, of silicon oxide ($SiO_2$). The interface layer 803 has, for instance, a thickness between approximately 0.5 μm and 5 μm, in particular approximately 1 μm.

On the interface layer 803 a structural layer 805 of epitaxially grown polysilicon is formed, having a thickness between approximately 10 and 1000 μm, in particular approximately 25 μm. In particular, the structural layer 805 is grown epitaxially until it reaches a thickness greater than the desired thickness (for example, approximately 3 μm ticker), and is then subjected to a CMP (Chemical Mechanical Polishing) step to reduce the thickness thereof and obtain a top surface 805*a* with low roughness.

The structural layer 805 may be of a material other than polysilicon, for example silicon or some other material, provided that it may be removed in a way selective in regard to the material of which the interface layer 803 is made.

Figure 17:
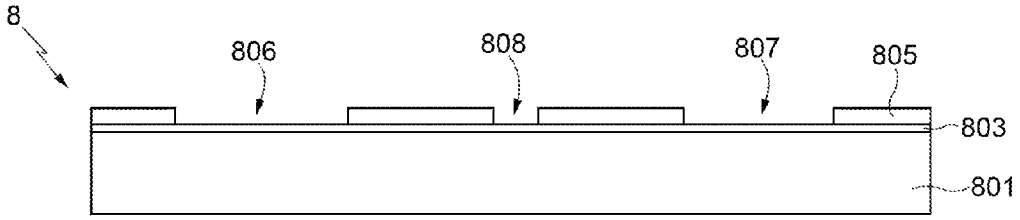

As shown in FIG. 17, a step of masked etching of the structural layer 805 is carried out to form a first trench 806 and a second trench 807 that will form, in subsequent steps, the first and second restriction channels 16, 18. Through the first and second trenches 806, 807 respective surface regions of the interface layer 803 are exposed. The first and second trenches 806, 807 have, in top plan view in the plane XY, a rectangular shape with their major side in the direction X and their minor side in the direction Y. The depth is defined by the thickness of the structural layer 805. During the same etching step a hole 808 is further formed, for example having a circular section in the plane XY and a diameter between 2 μm and 200 μm, and a depth equal to the thickness of the structural layer 805. The hole 808 will form, in subsequent manufacturing steps, part of the nozzle 13.

Figure 18:
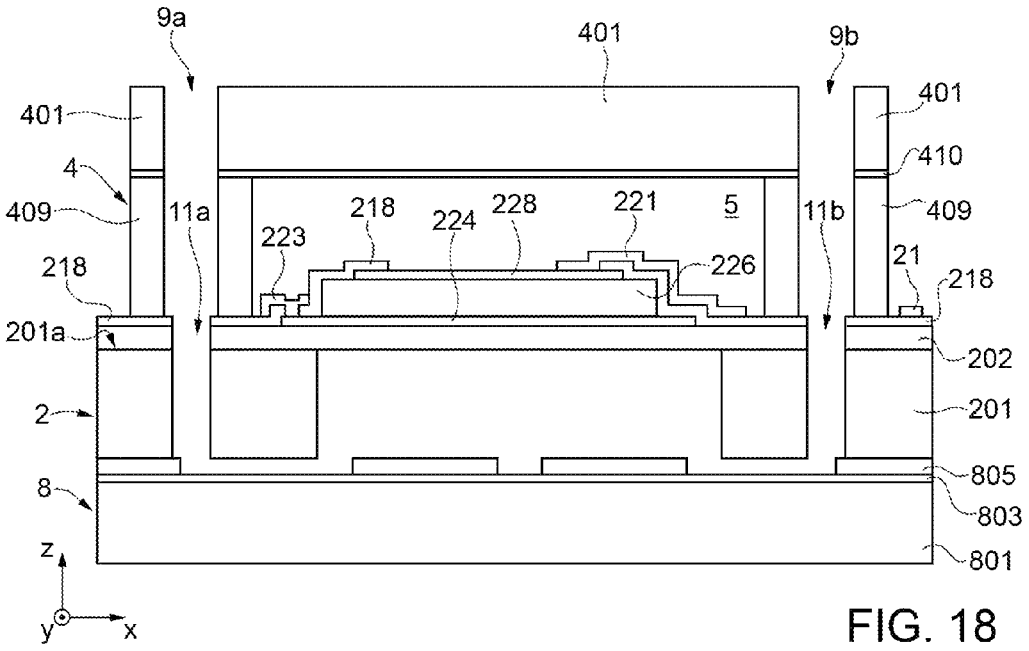

As shown in FIG. 18, a step of coupling of the third wafer 8 to the first wafer 2 is carried out. This coupling step may take place prior to the step of FIG. 15A, or after said step.

To facilitate execution of subsequent manufacturing steps, the second wafer 4 may be coupled, by a thermal-release biadhesive tape, with a further wafer, having the sole function of favoring handling of the device that is being produced. This step is not shown in the figures. At the end of the manufacturing process, said further handling wafer will be removed. The handling wafer is, for example, of silicon and has a thickness of approximately 500 μm. The thermal-release biadhesive tape is, for example, laid on said wafer by lamination.

Figure 19:
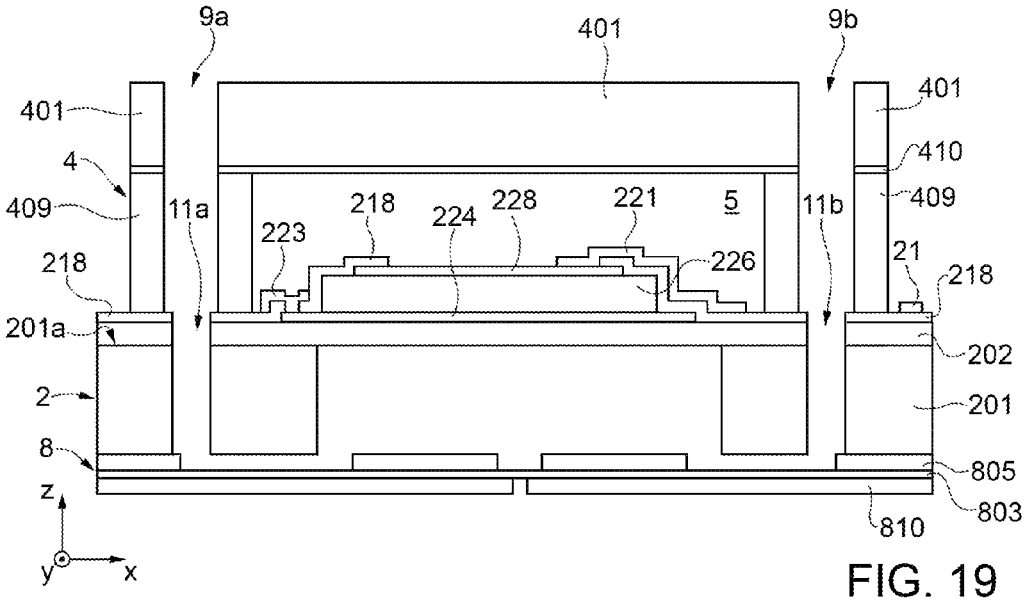

With reference to FIG. 19, the substrate 801 of the wafer 8 is completely removed with a grinding step and a subsequent chemical-etching step for removal of any possible residue of the substrate 801 not removed by the grinding step. Chemical etching further presents the advantage of being more precise than grinding, and the etching chemistry may be chosen so to be selective in regard to the material to be removed, the etch stopping at the interface layer 803.

It is thus advisable, in this step, to provide alignment markers (not shown) on the exposed interface layer 803. Said markers have the function of identifying with high precision, in subsequent processing steps, the spatial arrangement of the hole 808, to complete formation of the fluid ejection nozzle.

Figure 20:
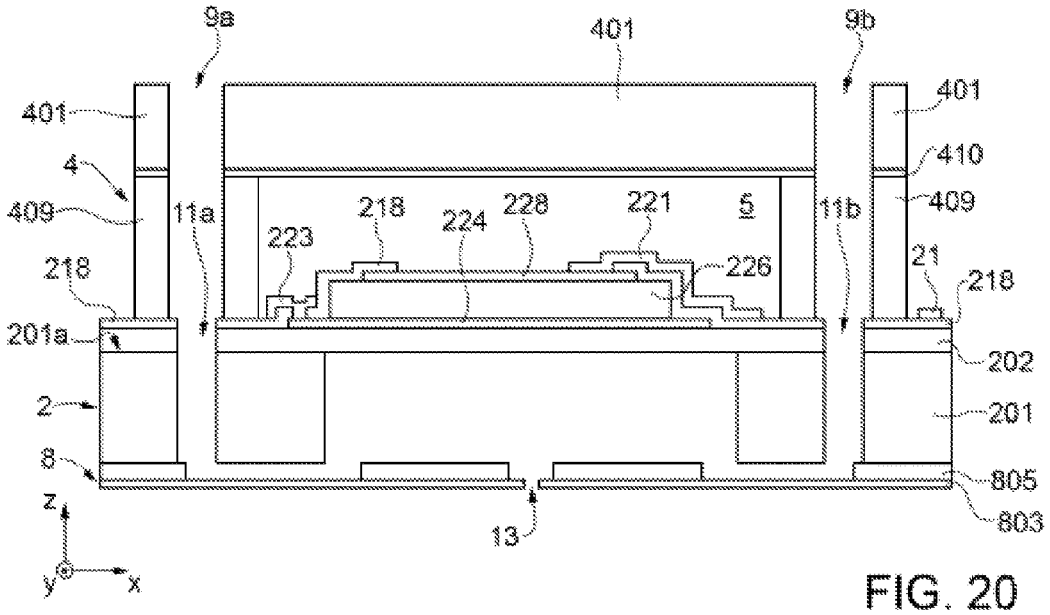

As shown in FIG. 20, a step of formation of a resist mask 810, of lithography, and of development of the resist mask 810 is carried out to expose a portion of the interface layer 803 where the ejection hole of the nozzle 13 is to be formed, and finally etching of the underlying interface layer 803 is carried out to form a through hole 812, having a circular section in the plane XY, coaxial to the hole 808.

Finally, the resist mask 810 is then removed, thus completing formation of the nozzle 13. The device 1 of FIG. 1A is thus formed.

Figure 21:
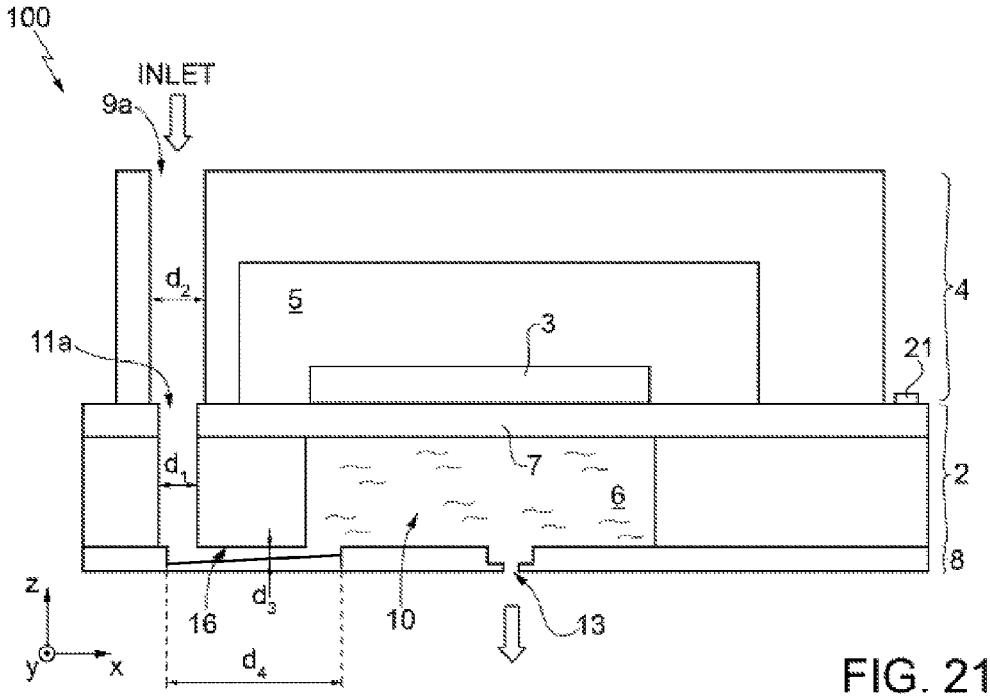
FIG. 21 is a lateral sectional view of a fluid ejection device according to a further embodiment of the present disclosure.

FIG. 21 shows a further variant of the present disclosure. According to this embodiment, the outlet channel 9*b*, the intermediate outlet channel 11*b*, and the second restriction channel 18 are not present. In this case, an ejection device 100 is similar to the ejection device 1 of FIGS. 1A and 1B and is manufactured as described in FIGS. 2-20 except for the steps that envisage formation of the outlet channel 9*b*, of the intermediate outlet channel 11*b*, and of the second restriction channel 18, which are not carried out. Thus, according to this embodiment, there is not envisaged recirculation of the fluid, which, after it has been introduced into the chamber 6, exits from the ejection device 100 only through the nozzle 13, during the operating step of printing/fluid ejection. The remaining elements that form the ejection device 100 are common to those of the ejection device 1, and thus are designated by the same reference numbers and are not described any further.

From an examination of the characteristics of the disclosure provided according to the present disclosure, the advantages that it affords are evident.

In particular, the steps for manufacturing the liquid-ejection device according to the present disclosure specifies coupling of just three wafers, thus reducing the risks of misalignment, in so far as just two steps of coupling of wafers are utilized, and limiting the manufacturing costs.

Further, the risks of misalignment are further reduced by providing the restriction channels 16, 18 with a main extension in the plane of lie of the third wafer 8, i.e., in a direction orthogonal both to the direction of supply of the fluid from the inlet hole 9*a* and to the direction of ejection from the nozzle 13. Due to this, no special arrangements are necessary for coaxial coupling of channels that have sections different from one another, as is, instead, the case in the prior art where the restriction channels 16, 18 have a main extension coinciding with the direction of supply of the fluid from the inlet hole.

Finally, it is clear that modifications and variations may be made to what has been described and illustrated herein, without thereby departing from the scope of the present disclosure.

In particular, the embodiment described and shown in the figures comprises a single nozzle. Practical applications generally specify formation of a plurality of nozzles according to the amount of liquid to be ejected. In this case, the ejection device will be formed by a plurality of base ejection modules of the type described and represented in the figures, adjacent to one another and obtained with common micromachining steps starting from the same wafers of semiconductor material.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A fluid ejection device, comprising:

a first semiconductor body including:

an actuator;

a chamber for containing a fluid, the actuator being configured to cause ejection of the fluid during an operating condition of the ejection device; and an inlet channel configured to provide fluid to the chamber, wherein the inlet channel extends in a first direction and has a section having a first dimension;

a second semiconductor body coupled to the first semiconductor body, the second semiconductor body having an ejection nozzle that is in fluidic communication with the chamber and is configured to expel an amount of fluid towards an environment external to the ejection device, the second semiconductor body comprising a restriction channel fluidically coupled to the inlet channel, the restriction channel extending in a second direction that is orthogonal to the first direction, the restriction channel having a section having a second dimension that is smaller than the first dimension, the restriction channel forming a fluidic path that fluidically couples the inlet channel to the chamber; and a third semiconductor body arranged on the first semiconductor body, the third semiconductor body including an inlet manifold that extends in the first direction as a prolongation of the inlet channel and has a section having a third dimension greater than the first dimension of the section of the inlet channel and greater than the second dimension of the section of the restriction channel.

2. The fluid ejection device according to claim 1, wherein the dimension of the section of the inlet channel is constant throughout the extension of the inlet channel.

3. The fluid ejection device according to claim 1, wherein the dimension of the section of the restriction channel is constant throughout the extension of the restriction channel.

4. The fluid ejection device according to claim 3, wherein the section of the inlet channel has a dimension between 20 μm and 200 μm and the section of the restriction channel has a dimension between 2 μm and 300 μm.

5. The fluid ejection device according to claim 1, wherein:

the restriction channel is in direct fluidic connection with the inlet channel; and the dimension of the section of the restriction channel is variable and assumes a maximum value where the restriction channel fluidically connects to the inlet channel.

6. The fluid ejection device according to claim 1, wherein the ejection nozzle is configured to eject the fluid in a direction of ejection that is parallel to the first direction and orthogonal to a plane of lie of the second semiconductor body, the second direction being parallel to the plane of lie of the second semiconductor body.

7. The fluid ejection device according to claim 1, wherein the third semiconductor body further includes an outlet manifold that extends in parallel to the first direction as a prolongation of the outlet channel and has a section having a dimension that is greater than the dimension of the section of the outlet channel.

8. The fluid ejection device according to claim 1, wherein the actuator includes a membrane arranged on the chamber and a piezoelectric element arranged on the membrane, wherein the piezoelectric element is configured to displace the membrane towards or away the chamber in response to receiving an electrical signal.

9. The A fluid ejection device comprising:

a first semiconductor body including:

an actuator;

a chamber for containing a fluid, the actuator being configured to cause ejection of the fluid during an operating condition of the ejection device;

an inlet channel configured to provide fluid to the chamber, wherein the inlet channel extends in a first direction and has a section having a first dimension; and an outlet channel for the fluid that extends at a distance from the inlet channel and in parallel thereto and is fluidically coupled to the chamber to enable recirculation of the fluid not expelled via the ejection nozzle;

a second semiconductor body coupled to the first semiconductor body, the second semiconductor body having an ejection nozzle that is in fluidic communication with the chamber and is configured to expel an amount of fluid towards an environment external to the ejection device, the second semiconductor body including:

a first restriction channel fluidically coupled to the inlet channel, the first restriction channel extending in a second direction that is orthogonal to the first direction, the first restriction channel having a section having a second dimension that is smaller than the first dimension, the restriction channel forming a fluidic path that fluidically couples the inlet channel to the chamber; and a second restriction channel that is coplanar to the first restriction channel and is configured to couple fluidically the chamber with the outlet channel, the second restriction channel having a section having a dimension that is smaller than the dimension of the section of the outlet channel.

10. The fluid ejection device according to claim 9, wherein:

the restriction channel is in direct fluidic connection with the inlet channel; and the dimension of the section of the restriction channel is variable and assumes a maximum value where the restriction channel fluidically connects to the inlet channel.

11. A method for manufacturing a fluid ejection device, the method comprising:

forming, in a first semiconductor body, a recess at a first surface and an actuator at a second surface, the actuator being operatively coupled to the recess and configured to cause displacement of a fluid in the recess during an operating condition of the ejection device;

forming, in the first semiconductor body, an inlet channel having a section with a first dimension;

forming, in a second semiconductor body, an ejection nozzle configured to expel said fluid during said operating condition of the ejection device;

forming, in the second semiconductor body, a restriction channel having a section with a second dimension that is smaller than the first dimension, wherein forming the restriction channel comprises forming a trench having a variable section; and coupling the second semiconductor body with the first semiconductor body so that the recess of the first semiconductor body forms a chamber with the second semiconductor body, wherein the chamber is configured to hold the fluid, wherein the restriction channel is in direct fluidic connection with the inlet channel and the chamber.

12. The method according to claim 11, wherein forming the restriction channel comprises forming, in the second semiconductor body, a trench having a constant section throughout a thickness of the second semiconductor body.

13. The method according to claim 12, wherein the section of the restriction channel has a dimension between 2 μm and 300 μm.

14. The method according to claim 11, forming the inlet channel comprises etching the first semiconductor body in a first direction.

15. The method according to claim 11, wherein forming, in the second semiconductor body, the restriction channel comprises etching the second semiconductor body in a second direction that is orthogonal to the first direction.

16. A fluid ejection device, comprising:

a first body comprising a semiconductor material and having a first and second surface, the first body including a first recess at the first surface, an actuator at the second surface and facing the first recess, and an inlet channel extending from the first surface to the second surface; and a second body comprising a semiconductor material, the second body coupled to the second surface of the first body, the first recess and the second body forming a chamber configured to hold a fluid, the second body including a second recess that forms a restriction channel with the first body, the restriction channel having a dimension that is between 2 μm and 300 μm and is less than a dimension of the inlet channel, wherein the chamber, the restriction channel, and the inlet channel are in fluid communication with each other, the second body further including at least one nozzle configured to eject the fluid from the chamber.

17. The fluid ejection device according to claim 16, wherein the recess in the second body is sloped so that the dimension of the restriction channel varies.

18. The fluid ejection device according to claim 16, wherein the dimension of the restriction channel is constant.

* * * * *